US007852209B2

(12) United States Patent
Shrode

(10) Patent No.: US 7,852,209 B2
(45) Date of Patent: Dec. 14, 2010

(54) INTELLIGENT OCCUPANCY MONITORING USING PREMISES NETWORK

(75) Inventor: Jeffrey W. Shrode, Louisville, KY (US)

(73) Assignee: Honeywell International Inc., Morristown, NJ (US)

( * ) Notice: Subject to any disclaimer, the term of this patent is extended or adjusted under 35 U.S.C. 154(b) by 260 days.

(21) Appl. No.: 11/342,417

(22) Filed: Jan. 30, 2006

(65) Prior Publication Data

US 2007/0176770 A1 Aug. 2, 2007

(51) Int. Cl.
*G08B 1/08* (2006.01)

(52) U.S. Cl. ..... 340/539.13; 340/332; 340/565; 340/567; 340/573.1; 340/825.36; 340/825.49

(58) Field of Classification Search ..... 340/539.13, 340/332, 565, 567, 541, 573.1, 825.36, 825.49
See application file for complete search history.

(56) References Cited

U.S. PATENT DOCUMENTS 3,866,173 A * 2/1975 Moorman et al. ..... 340/5.54
5,218,344 A * 6/1993 Ricketts ..... 340/573.4
5,400,246 A * 3/1995 Wilson et al. ..... 700/17
5,905,438 A * 5/1999 Weiss et al. ..... 340/636.1
5,977,913 A * 11/1999 Christ ..... 342/465
6,114,948 A * 9/2000 Astell ..... 340/332
6,348,860 B1 * 2/2002 Davis et al. ..... 340/525
6,661,343 B1 12/2003 Rocci
6,675,091 B2 * 1/2004 Navab ..... 701/207
6,762,686 B1 * 7/2004 Tabe ..... 340/573.1
6,956,474 B2 * 10/2005 Jakubowski ..... 340/539.1
7,180,420 B2 * 2/2007 Maurer ..... 340/572.1
7,233,781 B2 * 6/2007 Hunter et al. ..... 455/404.1
7,397,381 B2 * 7/2008 DiPiazza ..... 340/573.1
7,468,658 B2 * 12/2008 Bouressa ..... 340/539.1
7,567,174 B2 * 7/2009 Woodard et al. ..... 340/539.26
2003/0135324 A1 * 7/2003 Navab ..... 701/207
2006/0265195 A1 * 11/2006 Woodard et al. ..... 702/188

FOREIGN PATENT DOCUMENTS

WO WO 03/019492 A1 3/2003
WO WO 03/096152 A2 11/2003
WO WO 2007/028827 A1 3/2007

OTHER PUBLICATIONS

Extended European Search Report corresponding to European Patent Application No. 07250012.7, dated Dec. 12, 2007.

* cited by examiner

*Primary Examiner*—Daryl Pope
(74) *Attorney, Agent, or Firm*—Husch Blackwell LLP Welsh Katz

(57) ABSTRACT

An identification system combines RF identification tags with ambient condition detectors of a monitoring system. The tags could be carried by individuals in the region(s) being monitored to provide occupancy feedback to first responders in the event of an alarm condition.

14 Claims, 3 Drawing Sheets

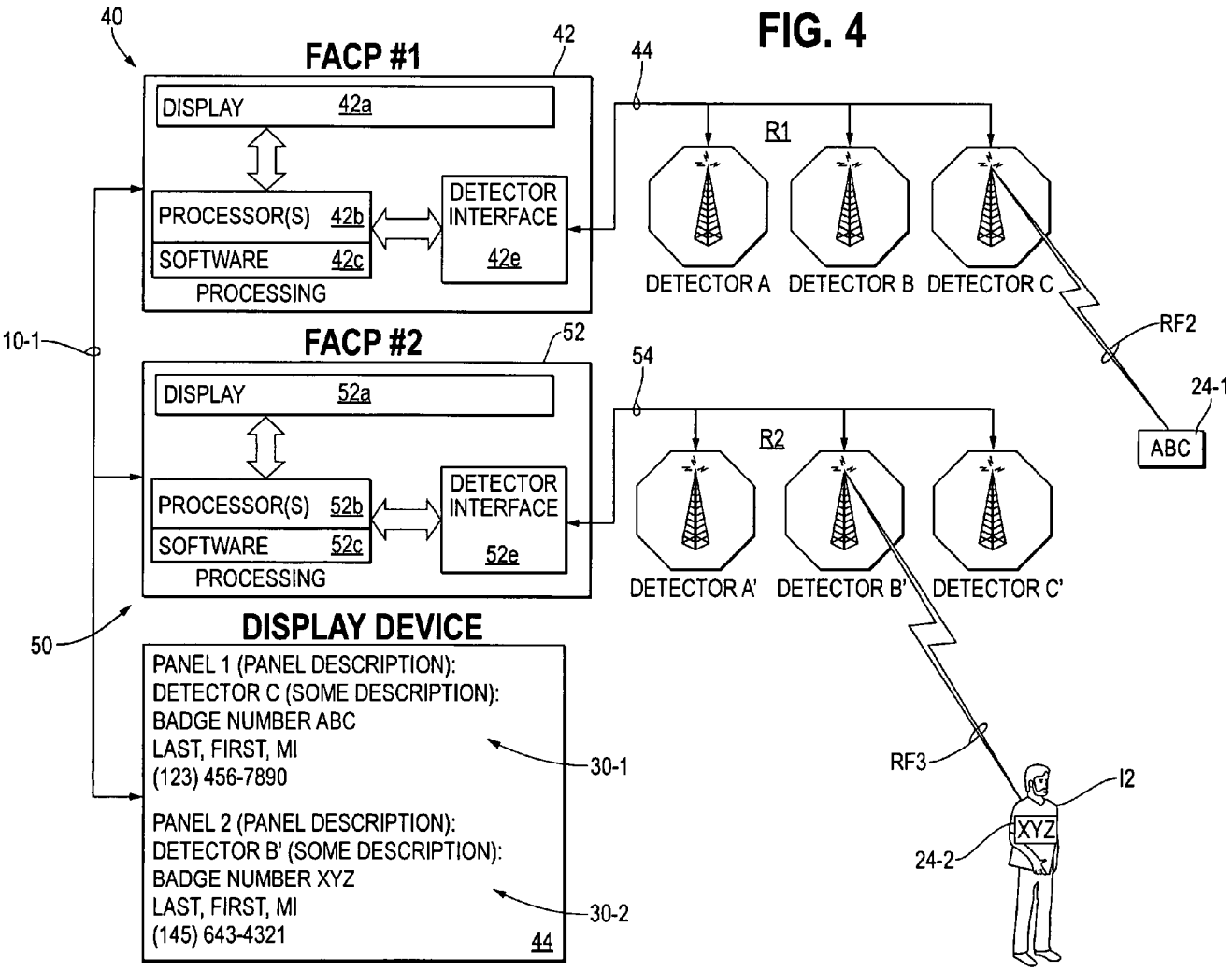
FIG. 4
FACP #1
DISPLAY
42a
PROCESSOR(S)
42b
SOFTWARE
42c
PROCESSING
DETECTOR INTERFACE
42e
42
40
44
R1
DETECTOR A
DETECTOR B
DETECTOR C
RF2
24-1
ABC
FACP #2
DISPLAY
52a
PROCESSOR(S)
52b
SOFTWARE
52c
PROCESSING
DETECTOR INTERFACE
52e
52
54
R2
DETECTOR A'
DETECTOR B'
DETECTOR C'
RF3
24-2
XYZ
12
DISPLAY DEVICE
PANEL 1 (PANEL DESCRIPTION):
DETECTOR C (SOME DESCRIPTION):
BADGE NUMBER ABC
LAST, FIRST, MI
(123) 456-7890
PANEL 2 (PANEL DESCRIPTION):
DETECTOR B' (SOME DESCRIPTION):
BADGE NUMBER XYZ
LAST, FIRST, MI
(145) 643-4321
30-1
30-2
44
10-1
50

INTELLIGENT OCCUPANCY MONITORING USING PREMISES NETWORK

FIELD OF INVENTION

The invention pertains to ambient condition monitoring systems such as fire or gas monitoring systems, intrusion detection systems and the like. More particularly, the invention pertains to such systems which are capable of detecting the presence of individuals in the region being monitored by the respective system and of providing information to first responders as to the locations of such individuals.

BACKGROUND OF THE INVENTION

It has been recognized that ambient condition monitoring systems such as fire, gas or intrusion systems can be very useful in providing information to first responders as well as to individuals on the premises as to the location and type of one or more alarm conditions. Such systems often monitor a variety of ambient conditions such as fire, gas, intrusion and the like to be able to determine the presence of the selected condition in one or more portions of the region being monitored.

In addition to monitoring the region itself, it would be desirable to be able to determine the location or locations of individuals who might be in the region being monitored when one or more conditions has been detected. For example, being able to determine that a group of individuals is on the second or third floor of a building which is experiencing a fire condition could be very useful to first responders.

It is would be preferable if such feedback could be provided relatively inexpensively without having to burden the respective individuals normally in the area. Further, it would be desirable to be able to communicate such information to remote premises from which first responders might be dispatched so as to provide them as much information as early as possible as to the conditions of the respective building or region being monitored.

BRIEF DESCRIPTION OF THE DRAWINGS

FIG. 4 is yet another block diagram illustrating other aspects of the invention.

DETAILED DESCRIPTION OF THE INVENTION

Figure 1:
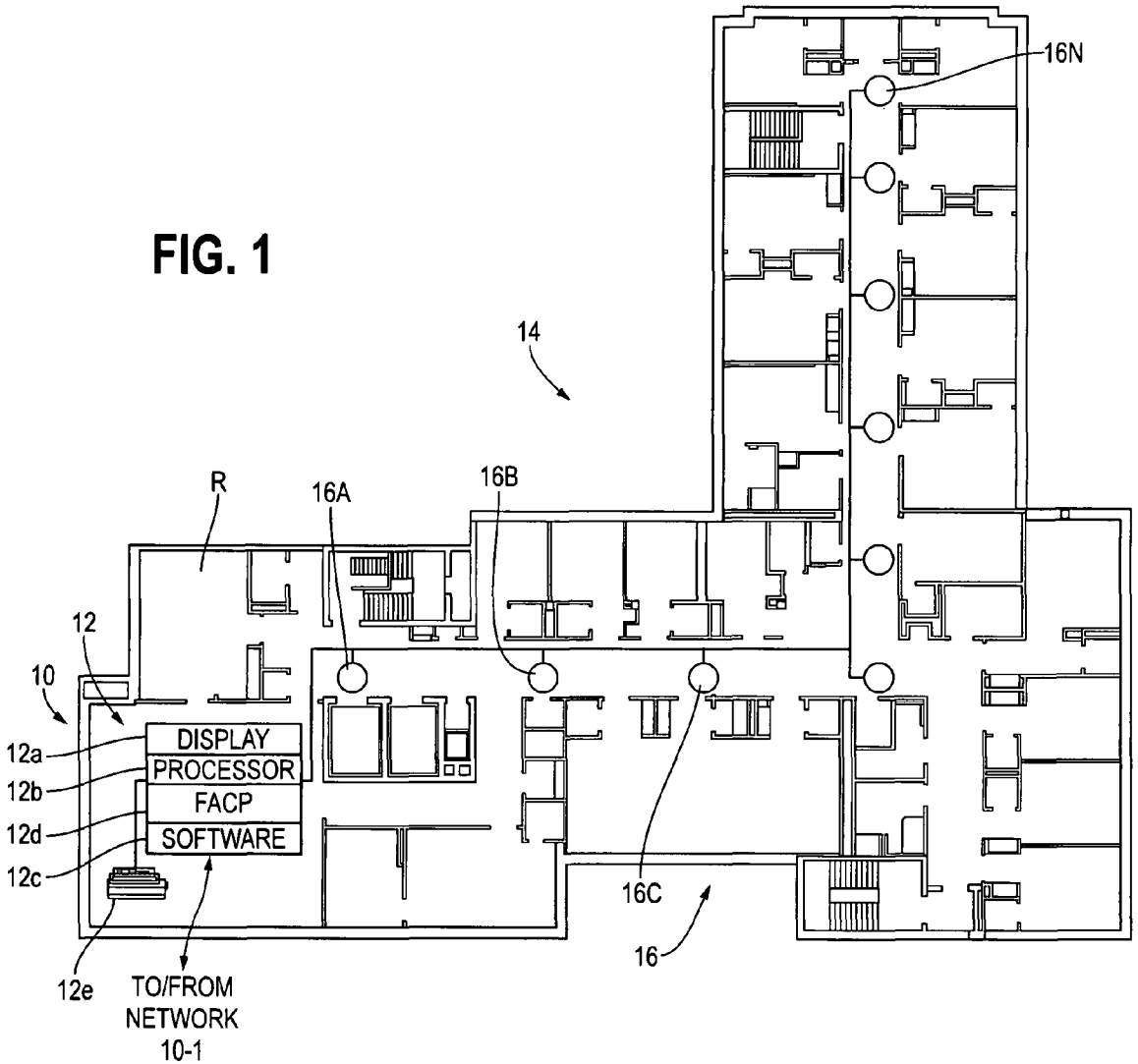
FIG. 1 is a plan view of a floor of a region being monitored in accordance with the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

A fire alarm control unit or panel (FACP) in one embodiment of the invention is configured to monitor members of a plurality of ambient condition detectors. Some of the detectors are capable of monitoring people. The detectors utilize a wireless signal to monitor a device such as a tag or badge attached to the person. A wireless signal is coupled between the detector(s) and the badge.

The connection between the FACP and the detector may be a physical medium such as wire or fiber. Alternately, the connection between the FACP and the detector(s) may also be wireless. The device which is attached to the person may be unique. It may be linked to some personal information about that person, or a general device may be used to simply identify where non-specific occupants are located.

A transmitter may be required to "activate" the badge(s). The transmitter may be located in one or more detectors along with a respective RF receiver or somewhere else in the facility.

The following scenarios are exemplary only and not limitations of the invention:

Scenario 1 (Specific Occupant, Specific Location, Alarm Condition):

The FACP is configured to link a unique badge to an individual.

At some point in time, the FACP annunciates a fire alarm. The emergency responder can view alarm related information at the FACP. The emergency responder needs to know who is located in the building. When the emergency responder requests a list of people in the building, either by pressing a single button or navigating some type of menu system, the FACP will request this information from the detectors. The detectors evaluate one or more received wireless signals to determine the badges from which a signal is being received.

The FACP can then link the badge to the configured information. The emergency responder may either view this information on the screen of the FACP, a displaced screen, or send it to a printer local to the FACP. Sample data include:

Badge number

Detector number

Detector description (such as the generic address or other pertinent information such as a location indicator, such as building number, floor number, room number, etc.)

User name (First, Middle, and/or Last, and optional suffix)

Contact telephone number

User Address

Alternate telephone number (such as a cellular telephone number)

Emergency contact name (First, Middle, and/or Last, and optional suffix)

Emergency contact telephone number

Emergency contact alternate telephone number (such as a cellular telephone number)

Emergency contact address

The FACP may be configured to include any or all of the sample data.

Additionally, the FACP will be able to display some grouping information. The FACP may either display or print information pertaining to the density of badge/personnel. This information may include, but not limited to, the following:

Detector Number

Detector description (such as the generic address or other pertinent information such as a location indicator, such as building number, floor number, room number, etc.)

Number of badges present by this detector

This information may be repeated for each detector. The list may also be sorted. Some examples of sorted lists include:

the detector with the most number of badges is listed first the detectors are listed in order of their address Scenario 2 (Specific Occupant, Specific Location, Continuous Monitoring):

The FACP is configured to link a unique badge to an individual

In this scenario the FACP continuously monitors the badges as they move throughout the building or facility. At any time the FACP has the ability to immediately display the badge information.

The FACP may be configured to include any or all of the sample data listed in Scenario 1.

Scenario 3 (Specific People, Specific Location, Additional Devices):

The FACP is configured to link a unique badge to an individual.

The FACP is connected to other devices, additional FACPs or additional reporting devices, using a network such as a protected premises network. The FACP will have the ability to transmit the badge/occupancy information to other devices on the network.

The badge/occupancy information may be sent over the network in accordance with either scenario 1 or scenario 2 listed above.

Additional information can be used when displaying information from multiple FACPs on a common display. The additional information which may be displayed includes:

Panel Number

Panel Description

Scenario 4 (General Occupancy, General Location):

The FACP is not configured to link unique badges to individuals.

In this scenario the FACP is only capable of determining badge locations. The information provided under this scenario will be that detector X has determined the total number of badges/occupants in the area of that detector.

The information which may be displayed at the FACP, printed by the FACP, or transmitted by this FACP to another annunciating device is not limited to but can include:

Detector number

Detector description (such as the generic address or more pertinent information such as a location indicator, such as building number, floor number, room number, etc.)

Number of occupants/badges in the area

This information may collected and sent over a network in accordance with Scenarios 1, 2, and 3.

FIG. 1 a plan view of a region R illustrates an installed fire alarm monitoring system generally indicated at 10. The system incorporates a fire alarm control panel 12 which is coupled via a medium, wired or wireless, generally indicated at 14 to a plurality of ambient condition detectors indicated generally at 16.

The detectors 16A . . . 16I will be understood could monitor conditions such as fire, smoke, gas, temperature, all without limitation. As those of skill in the art will understand the members of a plurality 16 would be distributed throughout the region R and coupled via medium 14 to the control unit 12. Control unit 12 incorporates a visual display 12*a*, a programmable processor or processors 12*b*, control software 12*c* various circuits associated with communicating with the detectors 16, indicated generally at 12*d* and one or more printers 12*e*.

The control unit 12 can incorporate condition monitoring processing software 12*c* of a conventional type in determining the presence of one or more predetermined alarm conditions based on wired or wireless signals received from the members of the plurality 16 via interface 12*e*. Further, the system 10 can be in communication, via a network 10-1, with one or more displaced systems all without limitation.

Figure 3:
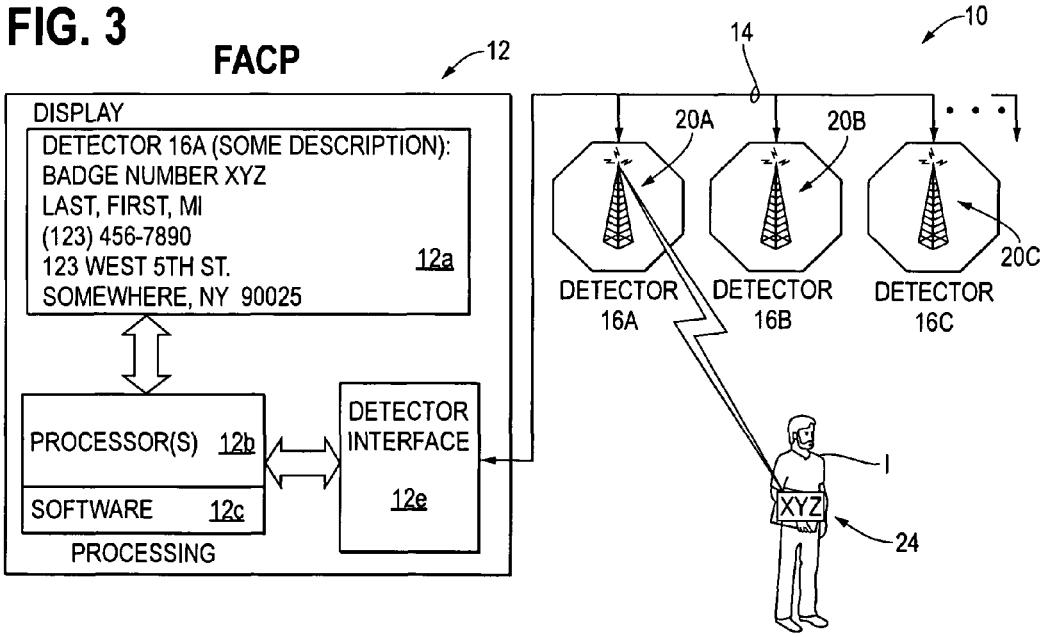
FIG. 3 illustrates further aspects of the system of FIG. 1.

In accordance with the invention, at least some of the detectors such as detectors 16A, B or C or the like incorporate wireless receivers 20A, 20B, 20C . . . 20N which might be configured as transceivers to receive signals from remote RF identification units such as 24*a* which could be, for example, passive RFID tags which have been incorporated into the identification passes or badges 24 which could be worn by individuals such as the individual I of FIG. 3 who are visiting or working the region R. Such RFID-type tags, where passive, rely on the presence of a local RF field for energy and transmit in response thereto, wirelessly, to a local receiver.

Figure 2:
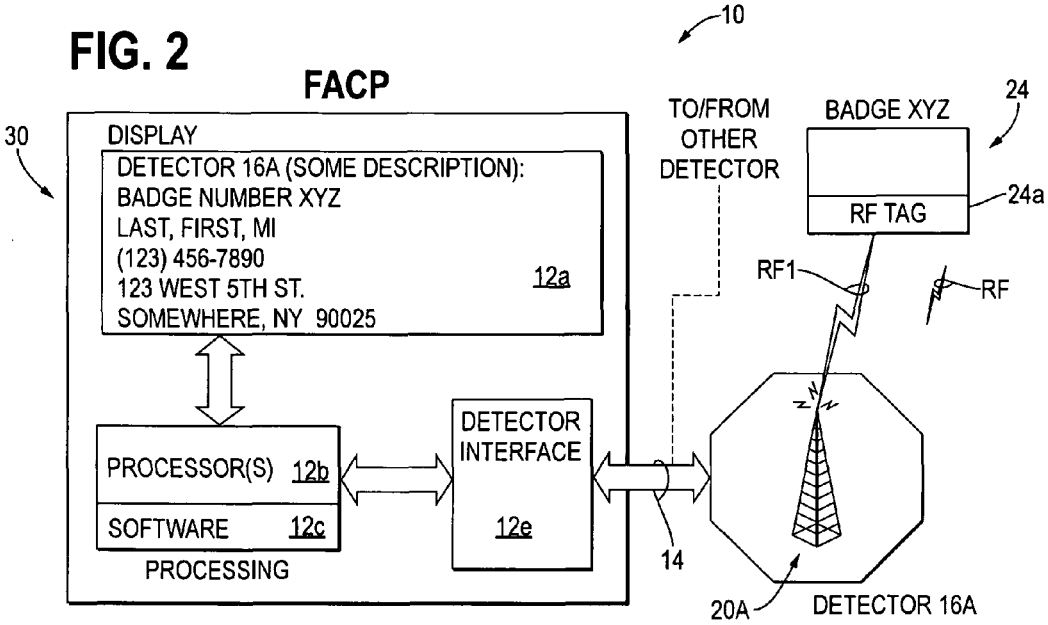
FIG. 2 is a block diagram view of various aspects of the system of FIG. 1.

As illustrated in FIGS. 2 and 3, the system 10 can incorporate in various of the detectors such as the detector 16A, illustrated in FIG. 2, at least a receiver indicated generally at 20A for receipt of signals from a local RFID tag 24*a*, embedded in badge XYZ, 24. As noted above, such tags, such as a tag 24*a* can be energized by local RF signals indicated generally as RF from a variety of sources.

One source could be transceivers associated with the various detectors such as detector 16A . . . 16N all without limitation. Another source could be one or more transmitters scattered throughout the region R, apart from the various detectors, for the purpose of generating local RF fields to energize nearby RFID tags. Alternately, RFID tags with a power supply built into a name tag for example could be used.

As illustrated in FIGS. 2 and 3, signals, such as indicated generally as RF1 can be received from one or more tags such as a tag 24*a* via receiver or transceiver 20A in a respective detector such as 16A in response to the presence of the respective tag or tags 24*a* in the vicinity of the receiver or transceiver 20A, B, . . . N. Information concerning relevant ambient conditions as well as information pertaining to identified RF tags in the vicinity of respective detectors can be coupled via medium 14 and interface 12*e* to the control panel or control unit 12. Such information can be displayed, generally indicated at 30 on the display 12*a* local to the control panel 12.

If desired the information can be transmitted via the network 10-1 to other sites for graphical presentation. The information 30, on display 12*a* can disclose to first responders the individual or individuals I in the vicinity of the detector 16A.

The information 30 can be provided prior to, along with or subsequent to the respective detector such as 16A communicating one or more ambient condition indicia to the control panel 12. It Will be understood that the exact relationship between information 30 and the ambient condition information coupled from the detector 16A . . . 16N to the control unit 12 is not a limitation of the present invention.

FIG. 4 illustrates an alternate configuration where first and second monitoring systems generally indicated at 40 and 42 can be coupled via the network 10-1 to a displaced display device 44 which could be located at a dispatching station, a firehouse, in or on first responders vehicles or the like all without limitation. As illustrated in FIG. 4, the respective detectors in the systems of 40, 42 each include an RF receiver, comparable to the RF receiver 20A of detector 16A for purpose of receiving RF signals, such as signals RF2, RF3 from respective badges 24-1, -2 which incorporate RF identification tags. It will be understood that the systems 40, 42 could be associated with regions R1, R2 in a common building or in physically displaced buildings.

Further, the local displays on the control units 42, 52 such as displays 42*a* and 52*a* could, if desired display the information 30-1 and 30-2 on the respective displays 42*a*, 52*a*.

It will also be understood that the type of monitoring system is not a limitation of the present invention. Embodiments of the invention can incorporate HVAC as well as intrusion indicating monitoring systems.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A method comprising:

providing a plurality of passive location indicators for use within a building or facility;

providing at least one locator activating electromagnetic field and at least some of the plurality of passive location indicators wirelessly transmitting location specifying indicia in response thereto;

sensing a first ambient condition selected from the group consisting of fire, smoke, gas and temperature at a first location within the building or facility;

sensing indicia from each of the plurality of passive location indicators received at one or more of a plurality of indicia sensing locations within the building or facility;

responsive to the sensed first condition at the first location, transmitting a representation of that condition to a displaced location;

transmitting indicia received from the plurality of passive location indicators by each of the plurality of indicia sensing locations to the displaced location; and displaying representations of the indicia including a location of each of the plurality of passive location indicators within the building or facility at a display location wherein each displayed representation of indicia is displayed adjacent an identifier of one of the plurality of indicia sensing locations that sensed the indicia.

2. A method as in claim 1 which includes associating person identifying indicia with respective ones of the displayed indicia.

3. A method as in claim 1 which includes sensing at least one type of ambient condition at a plurality of spaced apart locations.

4. A method as in claim 3 which includes transmitting a second plurality of different location specifying indicia to members of the plurality.

5. A method as in claim 4 which includes associating person specifying indicia with at least some of the transmitted location specifying indicia.

6. A method as in claim 4 which includes displaying members of the second plurality along with indicia which identify a respective member of the plurality of spaced apart locations.

7. A method as in claim 5 which includes displaying members of the second plurality along with indicia which identify a respective member of the plurality of spaced apart locations and which display at least one person specifying indicium.

8. A method as in claim 1 which includes transmitting a request for location specifying indicia to at least the first location.

9. A method as in claim 8 which includes determining that a predetermined ambient condition is present at least at the first location.

10. A method as in claim 9 which includes sensing a selected ambient condition at a plurality of spaced apart locations.

11. A system comprising: a plurality of ambient condition detectors within a building or facility, members of the plurality each detecting an ambient condition within the building or facility selected from the group consisting of fire, smoke, gas and temperature and each include an RF transmitter transmitting an energizing RF signal to a plurality of RF emitting identification tags, each of the plurality of RF identification tags rely upon the energizing RF signal for energy and each of the plurality of RF identification tags transmit in response thereto, an RF receiver of identifying signals emitted from members of the plurality of RF emitting identification tags in response to the energizing RF signal; and a control unit, displaced from the detectors which receives signals from the detectors indicative of sensed ambient conditions and a location of each of the plurality of RF emitting identification tags within the building or facility, the control unit displaying an identifier of each of the RF emitting identification tags displayed adjacent an identifier of one of the plurality of ambient condition detectors that received an identifying signal from the RF emitting identification tag.

12. A system as in claim 11 where at least some of the detectors forward indicia to the control unit, the indicia identify tags for which identifying signals have been received.

13. A system as in claim 12 where the control unit includes software, responsive to at least some signals from the detectors, which direct at least some of the detectors to forward the respective indicia.

14. A system as in claim 13 where the detectors comprise at least one of fire, flame, smoke or intrusion detectors.

* * * * *